United States Patent [19]

Gühne et al.

[11] Patent Number: 4,961,765

[45] **Date of Patent: * Oct. 9, 1990**

[54] ELECTRICAL VACUUM CLEANER AND FILTER BAG FOR SAME

[75] Inventors: Wieland Gühne, Remscheid; Heinz-Jürgen Ahlf, Bergisch-Gladbach; Manfred Eckart, Wuppertal, all of Fed. Rep. of Germany

[73] Assignee: Vorwerk & Co. Interholding GmbH, Wuppertal, Fed. Rep. of Germany

[ * ] Notice: The portion of the term of this patent subsequent to Dec. 5, 2006 has been disclaimed.

[21] Appl. No.: 338,876

[22] Filed: Apr. 14, 1989

[30] Foreign Application Priority Data

Apr. 29, 1988 [IT] Italy ..... 12462 A/88

[51] Int. Cl.[5] ..... B01D 46/02

[52] U.S. Cl. ..... 55/367; 55/374; 55/378; 55/473; 55/381; 15/351

[58] Field of Search ..... 55/467, 374–378, 55/473, 381; 15/327 R, 327 F, 327 D, 327 E, 351

[56] References Cited

U.S. PATENT DOCUMENTS

| | | | |
|---|---|---|---|
| 2,360,155 | 10/1944 | Nuffer et al. | 15/327 D |
| 2,564,468 | 8/1951 | Anderson | 15/327 E |
| 4,851,019 | 7/1989 | Heinz Jergen et al. | 55/373 |

FOREIGN PATENT DOCUMENTS

| | | | |
|---|---|---|---|
| 133904 | 12/1951 | Sweden | 15/327 E |

*Primary Examiner*—Bernard Nozick
*Attorney, Agent, or Firm*—Martin A. Farber

[57] ABSTRACT

The invention relates to an electric vacuum cleaner and the corresponding filter bag (7) which can be removed from a chamber (6) after opening and separating a socket connection. In order to achieve easier, cleaner handling upon changing the filter bag, the chamber (6) is separable by disengagement in a region of the shaft, about which the chamber can pivot, (14) after swinging separation from the filter bag (7).

14 Claims, 6 Drawing Sheets

FIG.9
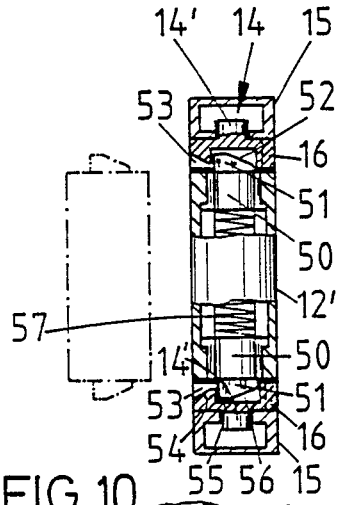
FIG.13
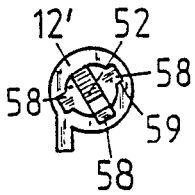
FIG.8
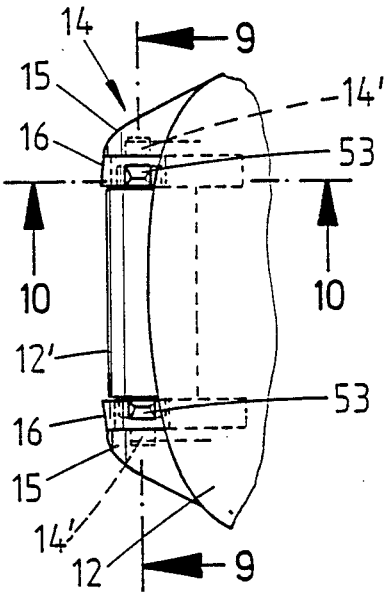
FIG.10
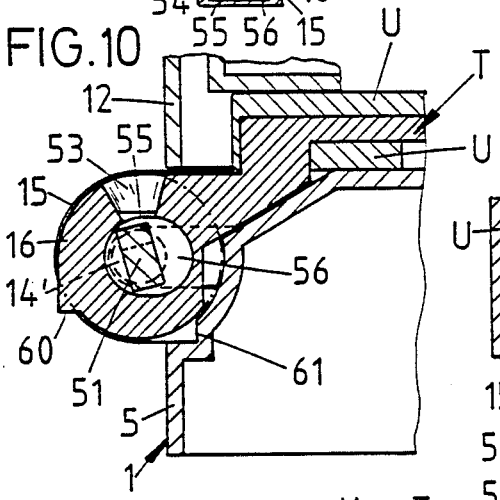
FIG.11
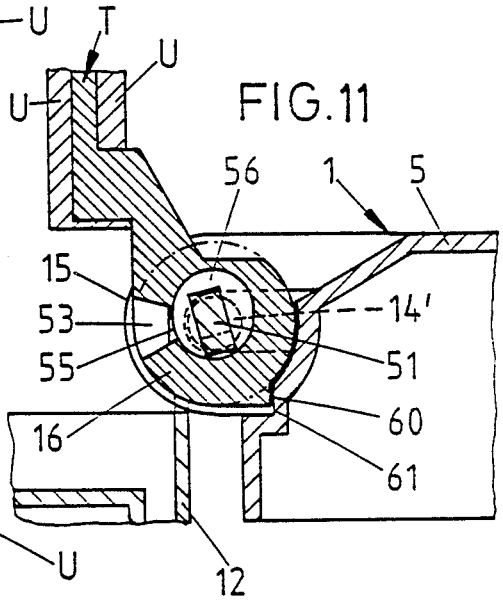
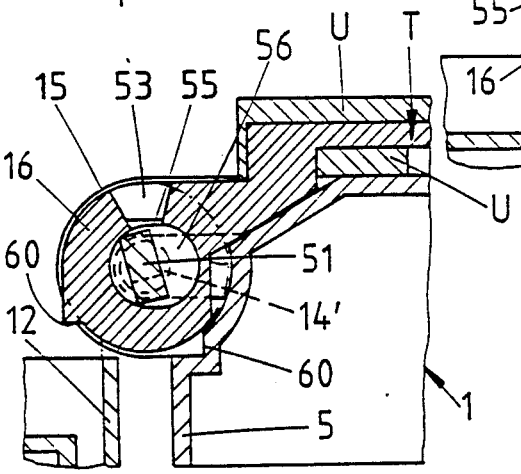
FIG.12

ELECTRICAL VACUUM CLEANER AND FILTER BAG FOR SAME

FIELD AND BACKGROUND OF THE INVENTION

The present invention relates to an electric vacuum cleaner having a chamber arranged above a motor fan for receiving a filter bag 7, the latter being connected by a socket connection (V) to a filter-bag intermediate support (T) which is carried along upon the swinging open of the chamber (6), the intermediate support having a valve closure body (K) and the filter bag (7) being capable of separation from the intermediate support at a point somewhat beyond a vertical position (vertical E—E) of the cross-sectional plane of the socket connection.

The changing of filter bags, including the removal of the full filter bag, requires some dexterity. It is the object of the invention to improve an electric vacuum cleaner of the type in question, in a manner which is simple to manufacture, with respect to the handling thereof and, in particular, in such a manner that the clean, convenient removal of a full filter bag is possible.

SUMMARY OF THE INVENTION

This object is achieved by the invention wherein the chamber (6) can be removed by disengagement in the region of a swing shaft (14).

Advantageous further features of the electric vacuum cleaner of the invention are presented in the ensuing description and claims.

As a result of this development, the handling of the filter bags on vacuum cleaners of the type in question is made substantially easier. The emergence of dust or the falling out of larger, heavier particles is substantially prevented. The filter bag can even be changed in the normal position of use of the electric vacuum cleaner. Handling is made optimal by the initial automatic separation of the socket attachment connection by the stopping of the swinging motion of the intermediate support and the further swinging of the chamber socket, and the possibility then established that the chamber socket can be disengaged from the swing shaft. In this way, the entire chamber containing the filter bag can be detached from the apparatus in an instant. This is not only an advantage from the standpoint of assembling but to a considerable extent also an advantage in use. For example, the chamber can in this way be cleaned conveniently from time to time without the entire apparatus being attached to it.

One then proceeds, in a structurally advantageous manner, in the way that the detent means are formed of pins which are under spring action with respect to each other in outward direction, each of the pins having a beveled trap head which cooperates with, in each case, a locking shoulder of journal-pin bearing lugs. This leads to a dependable detent plug connection which can be loosened at any time. It is furthermore favorable in this connection for the trap heads to have a flattened cross-section and for the journal-pin bearing lugs to have a radial slot adapted thereto. The corresponding flattening can be used as means for fool-proof attachment. The pins are fixed against rotation in order to assure in all cases proper alignment of the position of the trap head. Easier plug attachment results from the measure that the radial slot widens outward in funnel shape.

A favorable attachment furthermore results from the fact that the journal-pin bearing lugs are arranged on the intermediate support which, in its turn, is mounted, fixed on the housing, coaxial to the lugs. It is furthermore proposed to provide the intermediate support with an extrusion around it which forms a valve flap and the sealing lip for the transition over the housing air duct. Such an extrusion is made correspondingly soft. As a result, it performs, on the one hand, the function of a type of edge-bead seal while its further function resides in the formation of a valve. Since the material forming the valve flap extends over the region of the socket which is formed on the intermediate support and the wall surface of which is formed by the extrusion, a resilient plug seal is produced also in this region.

A further function of the extrusion resides in the fact that it simultaneously forms the cams which engage in position-centering manner into the grip openings. A precise fixing of the filter-bag bottom on the edge of the chamber socket is obtained in simple manner by the fact that at least two projections located on both sides of the opening grip over the filter-bag bottom. The specially shaped filter bag cannot be incorrectly inserted, it is extremely favorably fixed in position and applied elastically, and is for a long period of time tightly connected to the socket attachment and can be removed at any time without destruction, even when the bag is filled to the maximum.

BRIEF DESCRIPTION OF THE DRAWINGS

The subject matter of the invention will be explained in greater detail below with reference to an embodiment shown in the drawing, in which:

FIG. 8 is a top view of the edge portion of the apparatus, on the side of the swing shaft, FIG. 9 is a section along the line 9—9 of FIG. 8, FIG. 10 is a section along the line 10—10 of FIG. 8, illustrating the detent attachment position, FIG. 11 shows the position of the swing shaft in the condition of FIG. 7, FIG. 12 shows the position of readiness for removal, in which the chamber socket must still be swung slightly outward for the lifting out of the trap heads, so that the trap head assumes a congruent position to the radial slot above it, FIG. 13 is a front view of the region of the swing shaft.

DETAILED DESCRIPTION OF THE PREFERRED EMBODIMENTS

Figure 1:
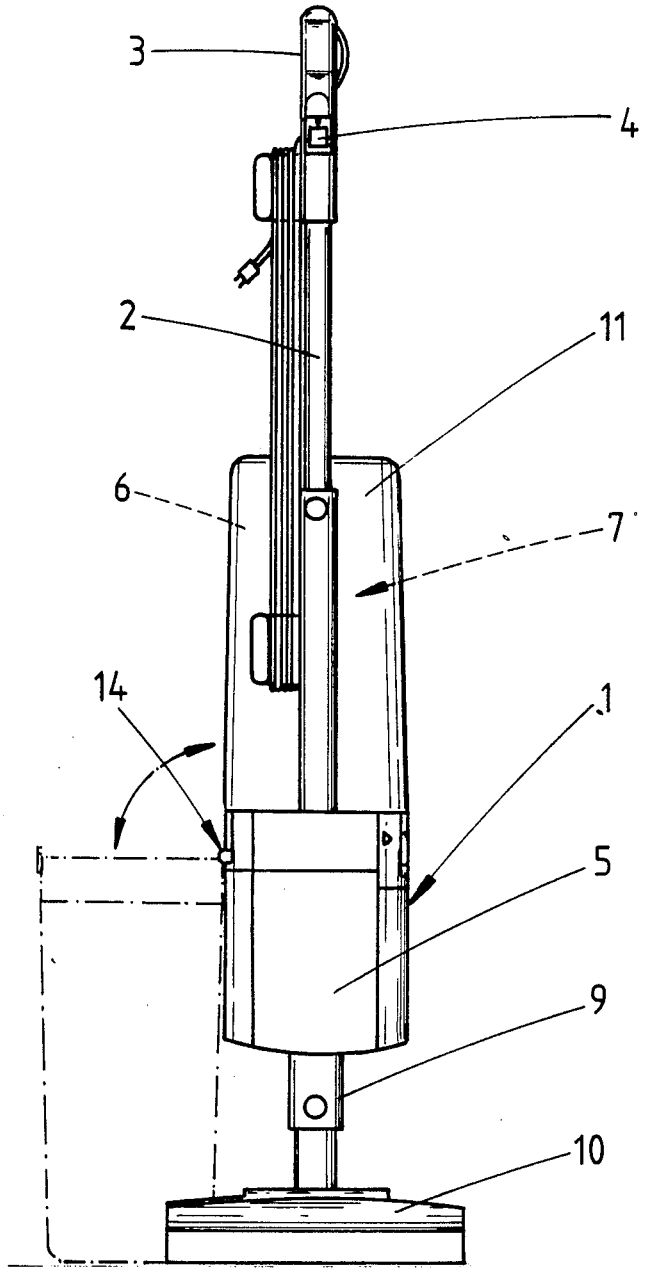
FIG. 1 is a view of a further developed version of the electric vacuum cleaner, with the swung-out position of the chamber containing the filter bag shown in dash-dot line.
Figure 2:
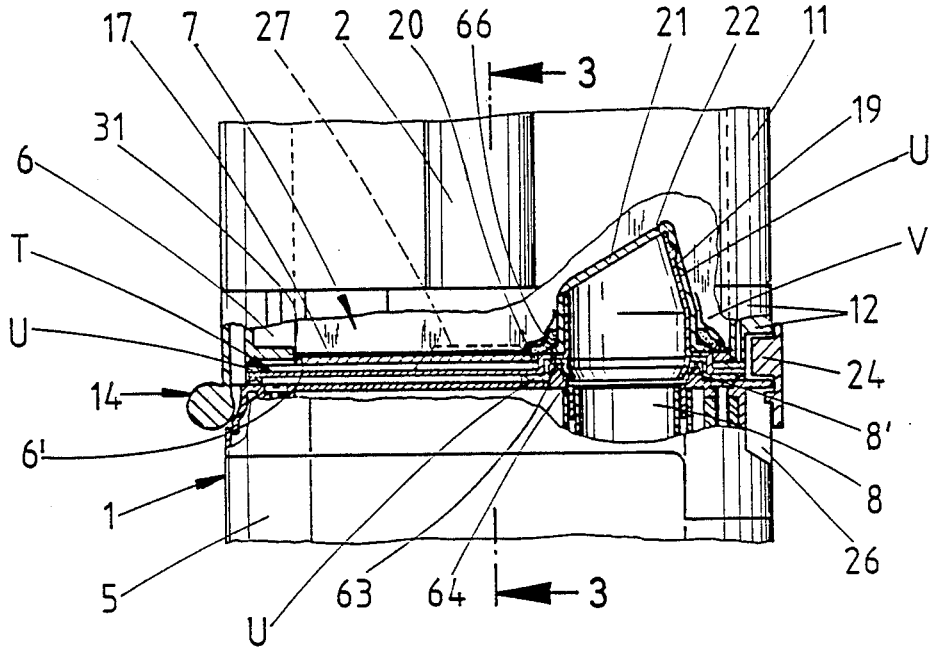
FIG. 2 shows the region of swing of this vacuum cleaner in closed position, partially broken away.
Figure 3:
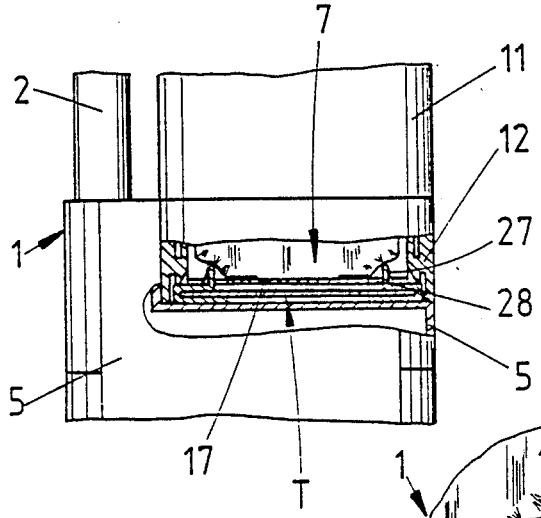
FIG. 3 is a section along the line 3—3 of FIG. 2, the section being broken away only in part.

With reference to FIGS. 1 and 2 the electric vacuum cleaner shown is designed as a hand-held apparatus. It has a housing 1 with a rod 2 at the top which has a handle 3 at its end. An on/off switch 4 is provided in the transition region between handle 3 and rod 2. The connection of the electric cord is not shown.

The housing 1 is divided into a motor housing 5 and a chamber 6 above it to receive a filter bag 7. The motor fan has also not been shown in detail in the drawing.

The side of the filter bag 7 facing the motor housing 5 is in communication via a socket V with the fan air duct 8.

The motor housing 5 passes on its bottom into a tube coupling 9 which establishes the air flow connection to a suction nozzle 10.

The suction nozzle 10 can be a so-called suction-brush nozzle which has a brush roller in the mouth of the nozzle, the brush roller being placed in rotation by a separate drive.

The fan motor therefore operates in upward direction and consequently forces the dust-laden air into the filter bag 7 arranged upside down above the motor housing 5.

The entire cross-section of the housing 1 is a long rectangle with slightly bulging broad sides and similar narrow sides. FIG. 1 shows the vacuum cleaner, seen from its broad side.

The chamber 6, which receives the filter bag 7 of corresponding cross-section is formed by a textile bag 11 which is stiffened by a wire basket and which passes on the bottom, i.e. on the side of the motor housing, into a stiffened edge in the form of a chamber socket 12. The stiffened textile bag 11 can be attached to this chamber socket 12 by means of releasable clip-plug connection. The plug-on region is stepped-down for this purpose. The step can be noted from FIG. 1. It permits a well-defined inner or outer attachment of the textile bag. An inner plug attachment is preferred.

For the removal of the filter bag 7, as shown in FIGS. 1–7, the housing 1 can be swung open with practically total freeing of its cross-section. The swung-open position can be noted from FIG. 1 (shown there in dash-dot line) and from FIGS. 5 and 7. The swing shaft 14 which makes this possible is located on one narrow side of the housing 1. Its bearing lugs on the chamber-socket side bear the reference number 15. These bearing lugs are located in the transition region between the narrow side and the broad side of the chamber 6. A continuous bearing lug of the motor housing 5 extends between the two bearing lugs 15.

Further details of construction are shown in FIGS. 2–13. In the region of the parting joint between motor housing 5 and chamber 6 there is furthermore integrated an intermediate support T on which the filter bag 7 is seated. The filter bag intermediate support T has a cross-section which is adapted to the cross-section of the housing but is set back from the wall of the housing so that in the coaxial position of motor housing 5 and chamber 6 shown in FIG. 1 it is substantially completely blocked from view. Except for a small place for access, it is namely gripped by the projecting lower edge of the chamber socket 12 of the filter bag intermediate support T which is also attached in swingable manner, and swings around the same swing shaft 14 as the filter-bag chamber 6. On the hinge side, the intermediate support T therefore also forms, in the same manner as the chamber socket 12, two bearing lugs provided here with the reference number 16.

Figure 14:
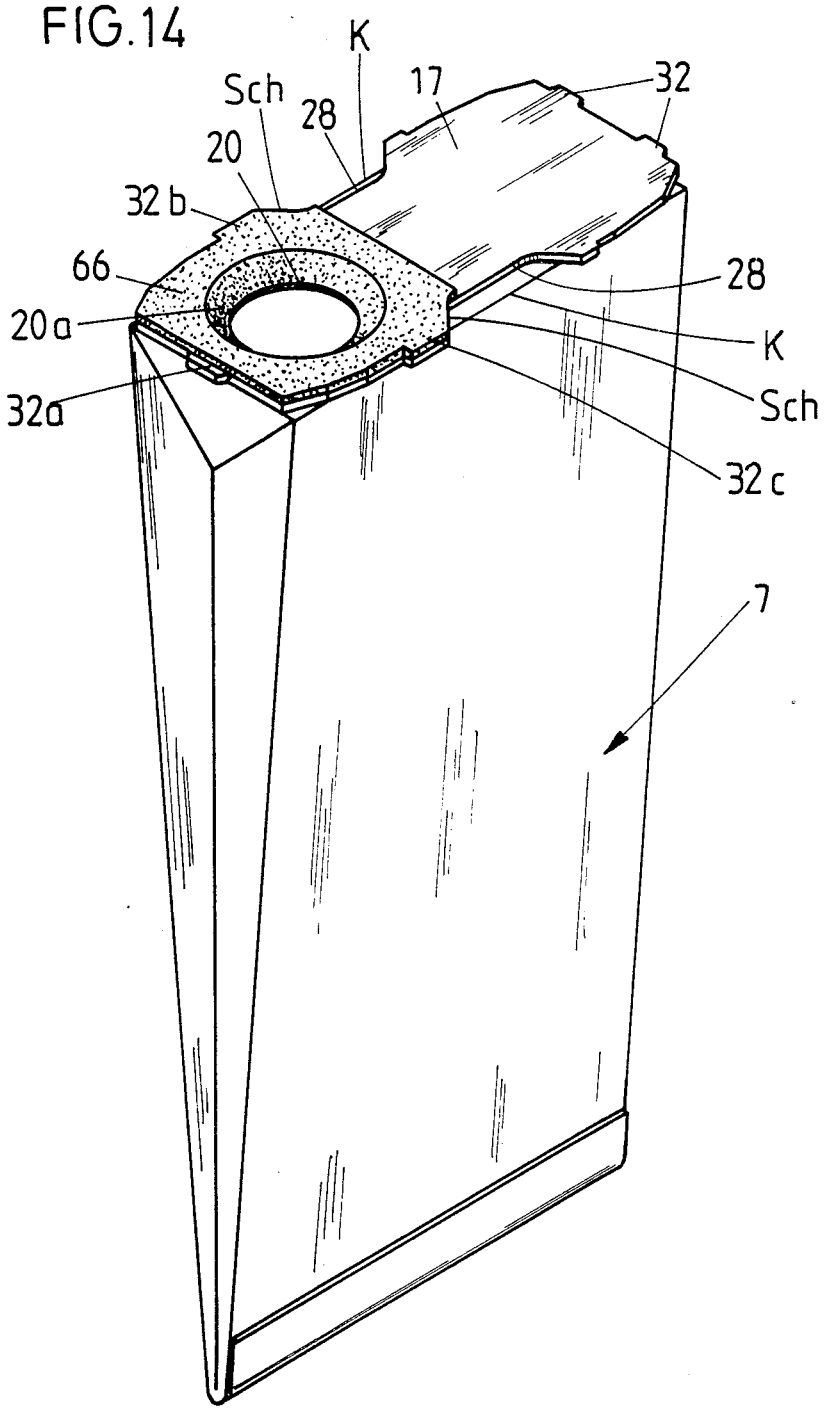
FIG. 14 is a perspective view of the corresponding filter bag.

The filter bag 7, shown in detail in FIG. 14, directly adjoins the intermediate support T and has a bottom or end wall 17. Its general contour also corresponds to the cross-sectional shape of the chamber socket 12 which for the supporting application in the region of the narrow sides of the end wall 17 forms one edge step 18 each on the inner wall. As a result of this, the end wall 17 cannot slide into the chamber 6 in the swung-open position of the apparatus. The bridge-like application of the end wall 17, on the other hand, results in a certain ability of the end wall to bend in the central region. The common swing shaft 14 of the chamber socket 12 and the filter-bag intermediate support T extends approximately at the level of the supporting edge step 18 of the filter-bag end wall 17. In the closed housing (FIG. 2), the edge step grips over the top side of said end wall 17 so that it is not pushed off in upward direction upon the suction blowing. As already indicated, the lower side of the end wall 17 rests on the top side of the filter-bag intermediate support T. There results in this connection, in the regions of the narrow side of the end wall 17, a sort of clamping-jaw fastening between the chamber socket 12 and intermediate support T.

In this position, with the stepped-down, cylindrical mouth end 8′ of the blower air duct 8 extends into the lower region of a socket 19. The latter protrudes above the top side of the filter-bag intermediate support T. The socket 19 is formed from the very start on the intermediate support T and, passing through an opening 20 of corresponding cross-section in the filter-bag end wall 17, extends into the inside of the filter bag 7, sealing the edge.

Figures 5, 6:
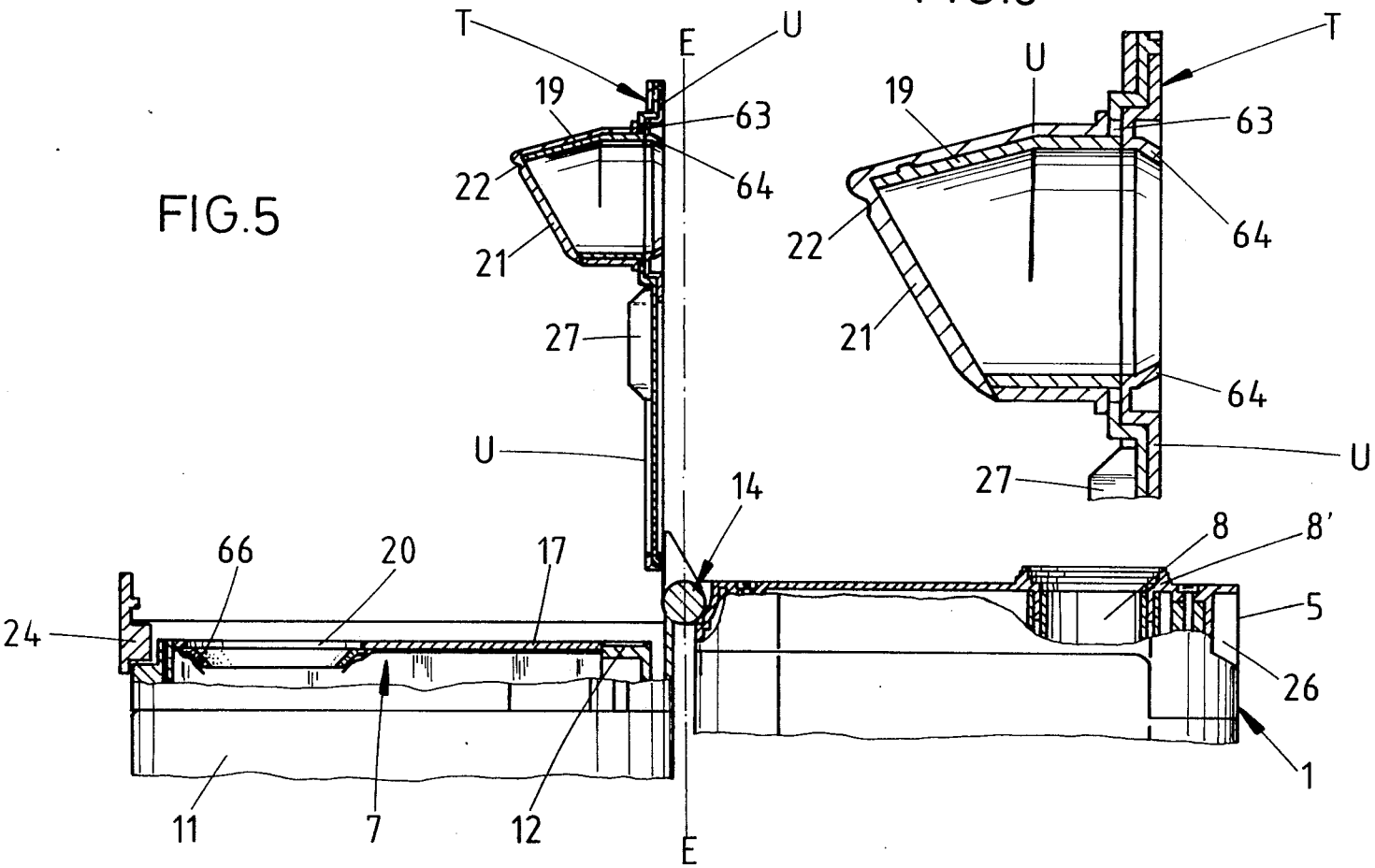
FIG. 5 is a sectional view corresponding to FIG. 2 but in opened condition and approximately vertically stopped position of the intermediate support.
FIG. 6 shows, greatly enlarged, the region of the socket with valve flap formed by the edge extrusion

In order to prevent sucked-in material falling back into the region of the motor housing 5 in view of the upside down position shown, the socket 19 is provided at its free end with a valve flap 21 (FIG. 2 and 6). The latter freely rests with the predominate part of its edge region on the end of the socket 19. It is fixed in position merely at the place designated 22, so that it lifts off under the action of the flow of air but returns into its closed position upon a reduction in the corresponding load on the bottom side. The valve flap 21 can be made as a separate part and be associated with the place 22 by means of a clip attachment; as an alternative there is of course the possibility of forming it thereon in the case of correspondingly flexible material of the socket 19 of the filter-bag intermediate support T.

The socket 19 tapers toward its free end so that its introduction into the opening 20 has practically a centering effect.

As can further be noted from FIG. 2, the end edge is beveled. It extends downward in the direction of the swing shaft 14. A theoretical line extended in this direction intersects the swing shaft. The connection point 22 is located in the higher region of the end edge of the socket.

The socket 19 furthermore has advisedly a radial curvature with respect to the shaft 14. The intermediate support T has window-like openings between the base region of the socket 19 and the region on the side of the swing shaft. The arm of the frame on the hinge side has, in this connection, a larger width than the two arms of the frame facing the broad sidewall of the housing.

On its free end, the intermediate support T forms at its end there a freely accessible handle 24. It is an angular extension on the bottom side. This extension comes from a region which is set back with respect to the end side 25 there. The corresponding leg extends vertically. The adjoining, substantially horizontal leg extends back to the outer wall of the housing and terminates in the same plane as the latter. In the region of the handle there is a hook detent device (not shown in detail) which can be actuated by a push button and secures the closed condition of the housing. The corresponding area of the motor housing 5 has a niche-like recess to receive the handle 24. The recess bears the reference number 26.

Upward-directed projections 27 extend also from the top side (in the position shown in FIG. 4) in the region of the longer frame arms of the intermediate support. The projections close grip openings 28 on the longer side edges of the filter-bag bottom 17. Both grip openings 28 are beveled and open toward the corresponding inner wall of the chamber socket. In the open position of the housing 1, the filter bag can be conveniently grasped by a clamping grip around the central zone of the bottom 17 of the filter bag, which zone has been constricted in the manner of a wasp's waist, and then be lifted out of the chamber 6. The filter-bag intermediate support T is furthermore so associated and developed in this connection that it moves through a limited angle of swing, i.e. it cannot pass into the 180° angle position of the chamber socket 12; rather it remains in the position which lies approximately in or beyond the vertical position E—E of the cross-sectional plane of the socket connection, so that the socket connection V is already beyond the bisector of the maximum region of swing of 180°. In this position, there is sufficient free space for the filter bag 7 in order to pull it off from the intermediate support.

The transfer into the position opposite the upside-down position, i.e. with the opening 20 pointing upward, takes place without it being possible for dust or larger particles to escape. The filter bag can therefore be grasped conveniently and lifted out in the above-described manner or after removal of the chamber. The wall of the bag is not pushed in. Its wall need not be touched upon its removal; any blowing out is eliminated. By stretching the bag a suction effect can at most be produced. The insertion of a new filter bag is possible in very simple manner in the same way, since the chamber is open toward the top over its entire cross-section FIGS. 1, 5 and 7. It is therefore merely necessary now to swing the chamber 6 back into the position shown in solid line in FIG. 1, in which position the upper structure of the housing 1 comprising the chamber 6 is automatically locked on the motor housing 5. Upon this swinging-back movement, the opening 20 entraps the socket 19, or vice versa. This can take place in the vertical position of the filter-bag intermediate support T which is possibly still present by frictional engagement or else only when the intermediate support rests with its back again on the top side of the motor housing 5. In the closed position, the projections 27 again fill the grip openings 28 practically completely, i.e. to such an extent that no outward bulges in the non-woven type paper filter wall 31 can occur upon the inflating of the filter bag or else due to the weight of the filling.

In order to enlarge the grip openings 28 which lie opposite each other, the wall region 12' of the inner wall of the chamber socket 12, which lies in this direction and therefore points outward, is hollowed out somewhat.

Figure 4:
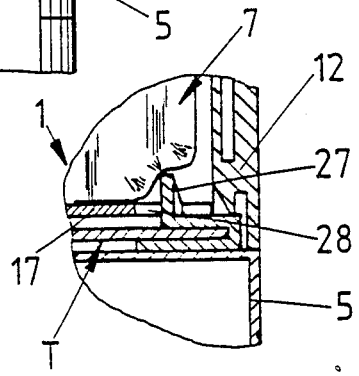
FIG. 4 shows, greatly enlarged, the right-hand edge portion of FIG. 3, illustrating the cam engagement.

With reference to FIG. 4, for a foolproof attachment of the filter bag 7 in proper position, the end wall 17 of the latter has, in the region of the two narrow sides, orientation features 32 which engage in mating features 33 in the region of the inner wall of the chamber socket 12. The orientation features consist of trapezoidal projections on the narrow side of the plate-shaped body forming the end wall 17. In this way there is obtained a properly aligned positioning of opening 20 and the socket 19 before an improper attachment is noticed by a coming together of the housing parts which does not permit closure. The facing longitudinal sides 27' of the projections 27 are rounded transversely, which also serves properly to position the end wall 17. They act as guide surfaces on the corresponding rounded base of the recess of the grip openings 28. Tongues **32*a*, 32*b* and 32*c* are provided in addition at symmetrical angles to the opening 20. The side-edge tongues 32*b* and 32*c* extend obliquely into the grip openings. They are covered on their top side with a foam material Sch which forms a sealing-ring zone of the hole 20. The fold edges K of the wall (paper) of the filter bag held against the end wall side of the bottom 17 intersect the grip openings, and the tongues 32*b* and 32*c*** extend over them.

The chamber or chamber socket 12 can be disengaged from the swing shaft 14. In this way, it is possible to carry the chamber containing the full filter bag 7 conveniently to the garbage pail or the like. Furthermore, the chamber 6 and the textile bag 11 stiffened by a wire basket can be easily cleaned from time to time without the entire apparatus being attached to them.

The connection point on the chamber-socket side is a housing-like projection 12' formed thereon and extending into the region of the shaft 14, the projection extending practically in coincidence with the bearing lugs 15 fastened on the housing and the journal-pin bearing lugs 16 of the filter-bag intermediate support T. The detent means are formed by pins 50 which are under spring action with respect to each other and in outward direction. The pins extend beyond the end surface of the projection 12'. This protruding section is developed as a beveled trap head 51. The trap bevel bears the reference number 52. The trap heads 51 have a flattened cross-section and cooperate with the journal-pin bearing lugs 16 of the intermediate support T which lie in front of them. Each of these bearing lugs 16 forms an outwardly open radial slot 53. The radial slot 53 widens outward in funnel shape. The funnel shape favors a centering on the shaft centerline but it also forms a run-on flank 54 which corresponds to the angle of inclination of the trap bevel 52. The inverse end of the run-on flank 54 then continues into a blocking shoulder 55 transverse thereto, the back of the trap bevel engaging under the shoulder in locking manner. The blocking shoulder 55 is the partial wall region of a receiving recess 56 for the trap head 51 of the journal-pin bearing lugs 16. The narrowest width of the radial slot 53 corresponds to the flattened width of the trap heads 51.

The disengagement is only possible in the swung-down position of the chamber socket 12 and with the support T swung against the housing since the trap heads are then in the ready-for-disengagement position, as shown in FIG. 12. To be sure, in this position a further slight swinging of the chamber socket must be effected, since a partial region of the top of the trap head 51 is still in slight blocking engagement with respect to the receiving recess 56. Once the proper position for disengagement has been assumed, the chamber socket need only be lifted upward. The trap bevel 52 which points upward in this position then runs over the blocking shoulder 55. For the engagement, the run-on flank 54 of the radial slot 53 proves useful. It guides the trap heads back against the force of the compression spring 57 acting on the pins 55.

The compression spring 57 (FIG. 9) is a helical compression spring.

The pins 50 are secured against rotation. For this purpose they are provided with longitudinal ribs 58 which engage in longitudinal grooves 59 of corresponding contour in the recesses of the projections 12'. The inward directed ends of the pins 50 have stops so that the pins 50 do not jump out of their housing despite the spring pressure.

In all other possible angular positions, the trap heads 51 assume a blocking position relative to the corresponding journal-pin bearing lugs 16.

A different development of the swing-limiting stop for the intermediate support T can be noted from FIGS. 10 to 12, to the extent that the journal-pin bearing lugs 16 come against a shoulder 61 on the housing side by a radial stop projection 60.

The shaft 14 proper is formed by stub shafts 14' of the journal-pin bearing lugs 16, the stubs being formed in the back of the receiving recess 56 for the trap head 51. They extend into corresponding cavities in the bearing lugs 15 of the housing.

The receiving recess 56 is enlarged in the manner of a slot in the direction of the plane of extension of the intermediate support T.

Figure 7:
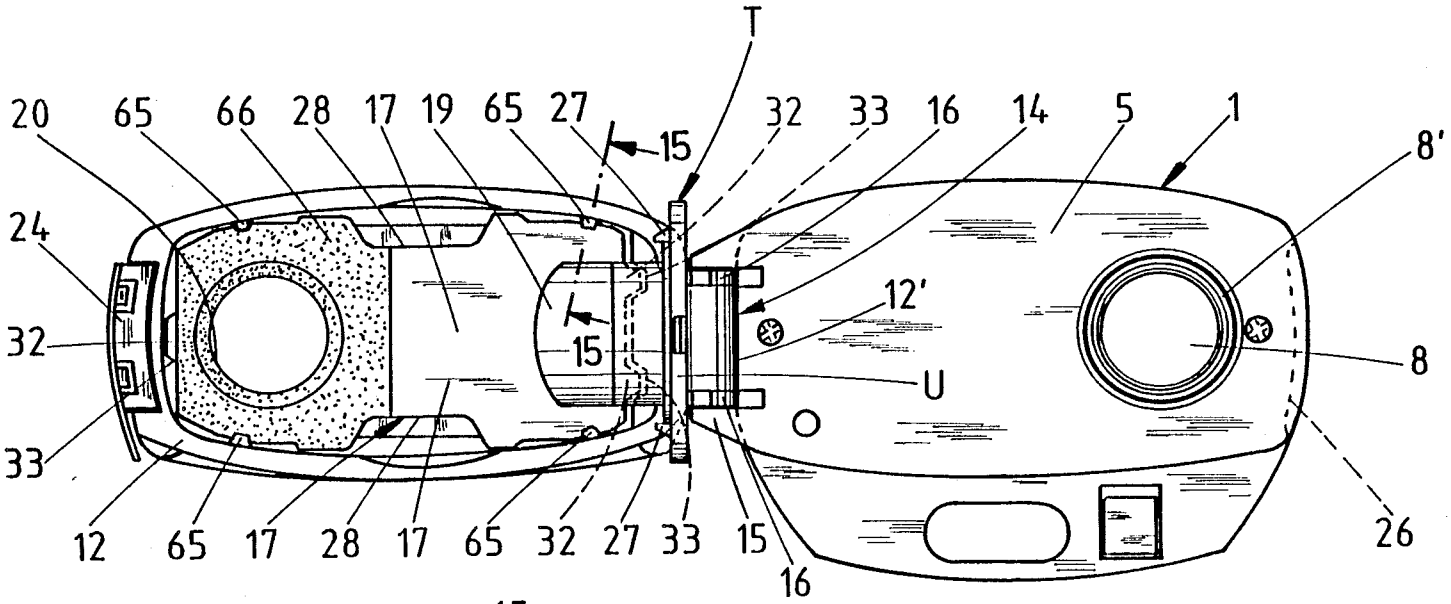
FIG. 7 is a top view of FIG. 5.

A further feature of the intermediate support T consists, in accordance with the version starting from FIG. 7, in providing the intermediate support T with an extrusion U. This extrusion consists of somewhat softer material than the intermediate support T. The extrusion extends at least on the edge side, so that not only is the narrow end edge of the plate-shaped intermediate support T covered but also the top and bottom sides of the intermediate support. The flexible material provides in this way an edge seal not only between the end wall 17 of the filter bag 7 but also with respect to the cover of the motor housing 5. Furthermore, the material of the extrusion U is also extended into the region of the socket 19 of the intermediate support T, surrounding this socket 19 in jacket-like manner. The corresponding change in the sides toward the top side of the intermediate support is provided by an edge perforation in the region of the base of the socket 19. The perforations are designated 63 and can be noted from FIGS. 5 and 6. In the region of the base of the socket 19, facing the blower air duct 8 located there, the extrusion forms a sealing lip 64 which extends into the stepped-down blower air duct. The sealing lip 64 tapers in funnel-shape on the duct side.

The extrusion furthermore forms the above-described projections 27 which extend into the grip openings 28 of the end wall 17 of the filter bag. The relatively soft material has at the same time sufficient flexibility so that no forced coupling occurs. The projections 27 are formed of upwardly bent off wall sections of the extrusion material (rubber or plastic), which wall sections have a curvature extending in longitudinal direction or else terminate only at their ends in curved sections, so that the desired standing ability is present despite the softness.

In order to increase the seal, the edge of the chamber socket 12 on the filter-bottom side is pointed in the manner of a cutting edge (see FIG. 4).

Figure 15:
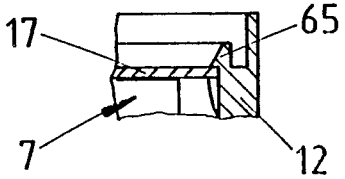
FIG. 15 is a section along the line 15—15 of FIG. 7.

Furthermore as shown in FIGS. 7 and 15, the filter-bag end wall 17 is gripped over by at least two projections 65 located on both sides of the opening 20 in the end wall 17. As can be noted from FIG. 15, the gripping width is rather small, so that the filter bag can be lifted out by a deliberate pull on the end wall 17.

Zones free of extrusion are only taken into account in the region of the emergence of the journal-pin bearing lugs 16 and in the region of the handle 25.

The orifice edge of the opening 20 of the end wall 17 is lined with an elastic layer 66 on the support side. This layer extends around the opening 20 up to the periphery of the bottom. It may be a foam material.

The extrusion U is utilized to form the valve flap 21. It is a cover which extends over the mouth of the socket and which is cut all around except at the hinge place 22.

The reference numbers have otherwise been applied by analogy, without repeating the description.

We claim:

1. An electric vacuum cleaner comprising a fan-motor housing and a chamber arranged above the fan-motor housing for receiving a filter bag, the housing having an inlet for receiving incoming air under suction and an outlet for directing the air to said chamber;

a filter-bag intermediate support, and a swing shaft about which the intermediate support is pivotally mounted, the swing shaft being supported by said housing, said chamber being pivotally mounted to said housing by said swing shaft, said intermediate support being located between said housing and said chamber, said chamber having an opening facing said intermediate support for removable insertion of the filter-bag into the chamber;

a socket connection extending from the filter-bag intermediate support for connecting the filter bag to the filter-bag intermediate support, the intermediate support being carried along upon a swinging open of the chamber about said swing shaft, the socket connection of the intermediate support having a valve closure body, and the filter bag being capable of separation from said intermediate support at a point somewhat beyond a vertical position of a cross-sectional plane of the socket connection; and wherein said chamber has lugs securing the chamber to said shaft, said shaft is formed with bevelled heads located for contacting said chamber lugs, the lugs bypassing the heads so that said chamber can be removed from the vacuum cleaner upon pivoted alignment of said lugs with said bevelled heads by disengagement of said lugs from said swing shaft.

2. An electric vacuum cleaner according to claim 1, wherein the disengagement is only possible after automatic separation of the socket connection between filter bag and filter-bag intermediate support, the intermediate support having lugs which free the chamber lugs to clear said bevelled heads upon a pivoting of said intermediate support away from the chamber opening.

3. An electric vacuum cleaner according to claim 1 including a filter bag, and wherein the socket connection extends to a bottom of the filter bag the surface contour of which corresponds approximately to a cross-section of the chamber opening; and the bottom of the filter bag rests on a step on an inner wall of the chamber socket, grip openings being provided at the chamber for securing the filter bag.

4. An electric vacuum cleaner according to claim 1, further comprising disengagement means coupled to said swing shaft, said disengagement means including said bevelled heads and said lugs of said intermediate support, and wherein said bevelled heads are formed of pins which are under spring action with respect to each other, said lugs of said intermediate support being journal-pin bearing lugs, and wherein in outward direction, a bevelled trap head of each of said pins cooperates with a respective blocking shoulder of the journal-pin bearing lugs.

5. An electric vacuum cleaner according to claim 4 wherein the pins are secured against rotation.

6. An electric vacuum cleaner according to claim 4, wherein the swing shaft is positioned at a housing of the cleaner; and the journal-pin bearing lugs are arranged on said intermediate support which, in its turn, is mounted fixed in the housing, coaxial to the lugs.

7. An electric vacuum cleaner according to claim 4, wherein said trap heads have a flattened cross-section, and the journal-pin bearing lugs have a radial slot adapted thereto.

8. An electric vacuum cleaner according to claim 7, wherein the radial slot widens in funnel shape toward the outside.

9. An electric vacuum cleaner according to claim 1, wherein said cleaner includes a fan air duct forming a part of said housing outlet, and the valve closure body of said intermediate support comprises a valve flap and a sealing lip; and said intermediate support is provided with an extrusion U which forms said valve flap and said sealing lip to extend over the fan air duct.

10. An electric vacuum cleaner according to claim 9, wherein the extrusion U forms projections which engage in grip openings which are provided on opposite longitudinal edges of a bottom of the filter bag.

11. An electric vacuum cleaner according to claim 9, further comprising at least two projections located in the chamber to be oriented with both sides of an opening of the bag; and a bottom of the filter-bag is gripped over by said projections.

12. A vacuum cleaner filter bag comprising a bag body closed at one end;

an end wall engaging with said body at a second end of said body opposite said one end; and wherein said end wall has an opening for the bag to serve as an air inlet to the bag;

said end wall has grip notches and three tongues arranged in angular symmetry to the bag opening; and two of the tongues are arranged on a side edge of the bag opening and extend directly into the grip notches via oblique flanks of the tongues.

13. A vacuum cleaner filter bag according to claim 12, further comprising a foam covering having a freely protruding annular zone; and wherein outer sides of at least the tongues, facing away from said bag body, are covered with said foam covering, the freely protruding annular zone of the foam covering being a part of the bag opening.

14. A vacuum cleaner filter bag according to claim 13, wherein a bag body comprises a filter bag wall; and the side edge tongues protrude up to outer fold edges of the filter bag wall located alongside of and intersecting with the grip notches.

* * * * *